US007610951B2

(12) United States Patent
Friese et al.

(10) Patent No.: US 7,610,951 B2
(45) Date of Patent: Nov. 3, 2009

(54) APPARATUS AND PROCESS FOR COOLING HOT GAS

(75) Inventors: Eckhard Heinrich Erich Otto Friese, Gummersbach (DE); Thomas Paul Von Kossak-Glowczewski, Gummersbach (DE); Joachim Papendick, Gummersbach (DE); Tycho Agien Van Der Plas, Amsterdam (NL); Manfred Heinrich Schmitz-Goeb, Gummersbach (DE); Edwin Bernardus Wilhelmus Gerardus Voeten, Amsterdam (NL)

(73) Assignee: Shell Oil Company, Houston, TX (US)

( * ) Notice: Subject to any disclaimer, the term of this patent is extended or adjusted under 35 U.S.C. 154(b) by 399 days.

(21) Appl. No.: 10/566,907

(22) PCT Filed: Jul. 27, 2004

(86) PCT No.: PCT/EP2004/051619

§ 371 (c)(1),
(2), (4) Date: Feb. 3, 2006

(87) PCT Pub. No.: WO2005/015105

PCT Pub. Date: Feb. 17, 2005

(65) Prior Publication Data

US 2008/0149316 A1 Jun. 26, 2008

(30) Foreign Application Priority Data

Aug. 6, 2003 (EP) ..... 03077464

(51) Int. Cl.
*F28D 7/10* (2006.01)

(52) U.S. Cl. ..... 165/108; 165/155

(58) Field of Classification Search ..... 165/108, 165/154, 155, 156, 163
See application file for complete search history.

(56) References Cited

U.S. PATENT DOCUMENTS 3,915,224 A * 10/1975 Richter et al. ..... 165/163
4,029,054 A * 6/1977 Schuurman ..... 165/158
4,245,696 A 1/1981 Van der Lelij ..... 165/134 R
4,445,563 A * 5/1984 Meyeroff ..... 160/369

(Continued)

FOREIGN PATENT DOCUMENTS

EP 0774103 B1 5/1997

(Continued)

OTHER PUBLICATIONS

International Search Report dated Oct. 20, 2004 (PCT/EP2004/051619).

*Primary Examiner*—Teresa J Walberg
(74) *Attorney, Agent, or Firm*—Charles W. Stewart

(57) ABSTRACT

Process to cool hot gas by passing the hot gas through a tube having a main tubular part and an upstream tubular part, wherein (i) the exterior of main tubular part is cooled by an evaporating liquid cooling medium flowing freely around said tube, (ii) the upstream tubular part is cooled by passing fresh liquid cooling medium and a defined part of the liquid cooling medium of activity (i) along the exterior of the upstream end of the tube and (iii) wherein the mixture of fresh cooling medium and the defined part of the liquid medium after being used to cool the upstream tubular part is used in activity (i) as cooling medium.

14 Claims, 6 Drawing Sheets

U.S. PATENT DOCUMENTS 4,488,513 A * 12/1984 Jahnke et al. ..... 165/163
5,671,807 A 9/1997 Lameris ..... 165/134.1
5,826,647 A 10/1998 Engelhardt et al. ..... 165/134.1
6,148,908 A * 11/2000 Brucher ..... 165/154
7,296,542 B2 * 11/2007 Schotz ..... 122/7 R

FOREIGN PATENT DOCUMENTS

WO 96/01403 1/1996

* cited by examiner

APPARATUS AND PROCESS FOR COOLING HOT GAS

PRIORITY CLAIM

The present application claims priority of European Patent Application No. 03077464.0 filed 6 Aug. 2003.

FIELD OF THE INVENTION

The invention relates to an apparatus and process for cooling hot gas which apparatus comprises a vessel provided with one or more heat exchanging tubes, the hot gas flowing through the said tube(s) and a cooling medium (e.g. water) flowing round the said tubes and the tubes being mounted at least at one end in a tube plate.

BACKGROUND OF THE INVENTION

Such heat exchange devices are used on a large scale in many branches of industry, e.g. in the petroleum industry for cooling products obtained from hydrocrackers and reactors for partial oxidation of (hydro)carbon-containing fuels such as oil and coal and the like.

When for cooling purposes the hot gases are passed through tubes which are cooled with a cooling medium on the outside, the walls of the tubes acquire a high temperature owing to transfer of heat from the hot gases to the tube metal which heat is further transmitted to the cooling medium. Advantageously, for reasons of space saving helically coiled tubes are applied.

Dependent on the field of application, technical problems of different nature are met.

E.g. the cooling of hot gases obtainable from the gasification of (hydro)carbon-containing fuel, in which the presence of small solid particles is unavoidable, involves serious heat transfer problems and erosion/corrosion problems.

For example, hot synthesis gas produced by partial oxidation of (hydro)carbon-containing fuel is generally cooled in a heat exchanger located next to the gasifier thereby producing high pressure steam. A critical area is the gas inlet of the heat exchanger where the hot synthesis gas enters the heat exchange area. The wall thickness of the inlet area is to be minimised but should be thick enough to ensure mechanical integrity based on pressure and thermal loads. The gas velocity at the inlet area should be sufficiently high to prevent fouling but on the other hand low enough to ensure sufficiently low gas side heat transfer coefficients. In particular, obtaining an optimum between fouling and velocity is desirable.

EP-A-774103 describes an apparatus for cooling of hot gas wherein the inlet section is cooled by passing fresh cooling medium, i.e. water, along the exterior of the upstream end of the heat exchanger tubes. The flow of water is counter-current to the flow of hot gas within the tubes.

U.S. Pat. No. 5,671,807 discloses an apparatus for cooling of hot gas wherein the inlet section is cooled by passing fresh cooling medium, i.e. water, along the exterior of the upstream end of the heat exchanger tubes. The flow of water is co-current to the flow of hot gas within the tubes.

According to EP-A-774103 and U.S. Pat. No. 5,671,807 the inlet area is cooled by using fresh water also referred to as boiler feed water (BFW). By using fresh BFW a great temperature difference between the cooling medium and the hot gas and thus the desired low metal temperatures can be achieved. The quantity of the BFW as fed to the inlet section is however defined by the steam production of the unit. In order to obtain sufficient flow velocities at the heat transfer areas, small flow cross sections, the annular gaps around said upstream part of the heat exchanger tubes, are required. Such small annular gaps are a particular challenge in terms of design. In addition the equal distribution of the flow to the great number of tube inlets to be cooled is difficult to ensure.

A further disadvantage of these designs is when a sudden complete outage of the BFW flow occurs due to for example a failure. In such a situation the cooling of the inlet section will not be sufficient and damage may occur. In another situation the BFW flow may change as a result of the boiler level control modulating the BFW control valve. Especially in case of load increases of the hot gas passing the heat exchanger tubes the BFW control valve is initially shut off due to the increase of the steam bubble volume in the vessel before it is opened again for compensation of the increased steam production. In such a situation the inlet section is temporarily not sufficiently cooled.

SUMMARY OF THE INVENTION

It is therefore an object of the present invention to provide a heat exchanger apparatus comprising a specific inlet section for better defined cooling and improved equipment lifetime and improved reliability which does not have the disadvantages of these prior art designs.

The invention therefore provides a process to cool hot gas by passing the hot gas through a tube having a main tubular part and an upstream tubular part, wherein (i) the exterior of main tubular part is cooled by an evaporating liquid cooling medium flowing freely inside a vessel and around said tube, (ii) the upstream tubular part is cooled by passing fresh liquid cooling medium and a defined part of the liquid cooling medium of activity (i) along the exterior of the upstream tubular part and (iii) wherein the mixture of fresh cooling medium and the defined part of the liquid medium after being used to cool the upstream tubular part is used in activity (i) as cooling medium.

The invention also provides an apparatus for cooling hot gas comprising:

(i) a vessel provided with a cooling medium compartment, an inlet to supply fresh cooling medium and a outlet for discharge of used cooling medium, said vessel further provided with an inlet for hot gas and an outlet for cooled gas, at least one heat exchange tube fluidly connecting the inlet for hot gas and the outlet for cooled gas positioned in the cooling medium compartment, wherein said tube is mounted at least at or near its upstream end in a tube plate, wherein (ii) a means for extracting a volume of the cooling medium from the cooling medium compartment is present and wherein (iii) the upstream end of the tube is provided with a cooling means comprising means to supply a mixture of the extracted cooling medium and part or all of the fresh cooling medium as supplied to said vessel along the exterior of the upstream end of tube.

It has been found that with the above process and apparatus the inlet section or upstream end of the tubular heat exchanger tube will be cooled, even in the event no fresh cooling medium is provided to the vessel, by the cooling medium which is extracted from the cooling medium compartment. Another advantage is that the flow of cooling medium mixture that is used to cool the upstream end of the tube can be controlled. Thus a method is provided wherein the cooling of the upstream part is less dependent on the flow of fresh cooling medium as fed to the cooling apparatus. Furthermore the annular gaps as described earlier for the prior art designs may be larger because a greater of volume of cooling medium mixture is used. Thus a more simple design is possible.

BRIEF DESCRIPTION OF THE DRAWINGS

The invention will now be described by way of example in more detail by reference to the accompanying drawings.

DETAILED DESCRIPTION OF THE INVENTION

Figure 1:
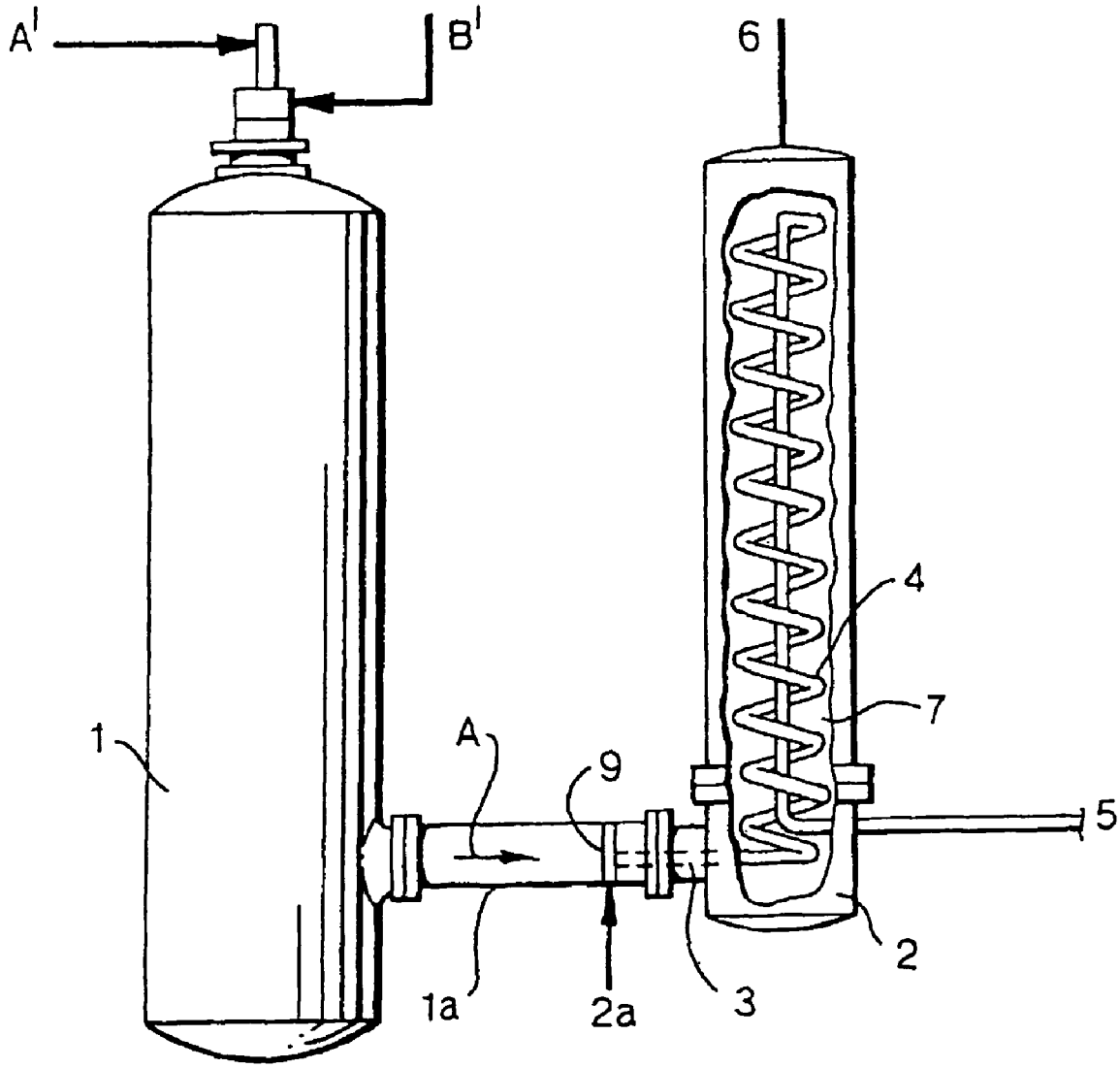
FIG. 1 represents schematically a sectional view of a heat exchanger of the invention connected to a reactor.

Referring to FIG. 1 a reactor 1 is shown for producing product gas e.g. by partial oxidation of hydrocarbon-containing fuel.

The product gas is supplied to a heat exchanger 2 and is further treated in any suitable manner after heat exchange. Such partial oxidation processes and appropriate process conditions are generally known to those skilled in the art and will therefore not be described in detail.

Generally, it can be said that (hydro)carbon-containing fuel A' (optionally with a moderator) and an oxidizer B' (optionally with a moderator) are supplied to the reactor 1 wherein raw hot synthesis gas is produced under appropriate process conditions.

The raw hot synthesis gas is supplied from the reactor 1 via a duct 1*a* to the gas inlet 9 of the heat exchanger vessel 2 located next to the reactor.

The arrows A represent the synthesis gas flow direction.

The mechanical connections of reactor and duct on the one side and duct and heat exchanger on the other side are made by means of any connections suitable for the purpose (e.g. flanges) (not shown for reasons of clarity). At the gas inlet 9 a tube plate 2*a* which closes the cooling medium compartment 7 of the heat exchanger vessel 2 is present. The configuration further comprising a duct 1*a* connecting said reactor and vessel 2. Vessel 2 further comprising at least a heat exchanger tube 4 fluidly connecting the gas inlet 9 with a gas outlet 5. The vessel also having an outlet 6 for steam. Advantageously, the tube plate 2*a* is flat and comprises 4-24 gas passages forming gas inlet 9 corresponding to respectively 2-24 tubes 4. It will be appreciated by those skilled in the art that the tube plate can be located in any manner suitable for the purpose, e.g. in the inlet for hot gas, within the vessel 2 of the heat exchanger or between the reactor 1 and the said inlet for hot gas.

Figure 2:
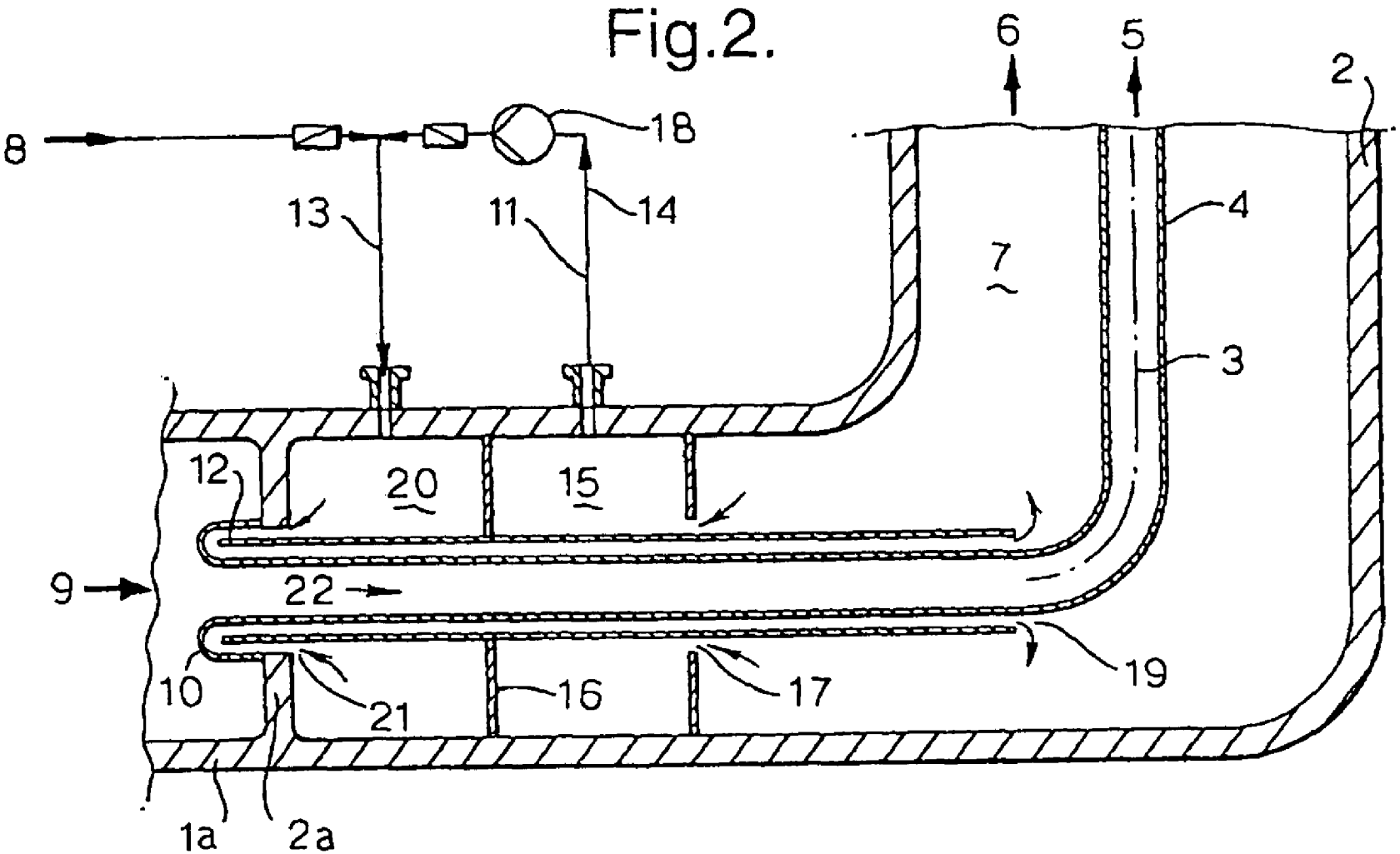
FIG. 2 represents schematically part of the vessel for cooling a hot gas according to the present invention including the upstream end of one heat exchanger tube.

FIG. 2 represents a partial longitudinal section of the apparatus of the invention. The same reference numerals as in FIG. 1 have been used. FIG. 2 shows part of a vessel 2 provided with a cooling medium compartment 7, an inlet to supply fresh cooling medium 8 and a outlet 6 for discharge of used cooling medium. Vessel 2 is further provided with an inlet 9 for hot gas and an outlet 5 for cooled gas and at least one heat exchange tube 4 fluidly connecting the inlet 9 for hot gas and the outlet 5 for cooled gas positioned in the cooling medium compartment 7. Suitable more than one tube 4 is present, more suitably between 2 and 24 parallel arranged tubes may be present within one vessel 2. Tube 4 is mounted at least at or near its upstream end 10 in a tube plate 2*a*. The tube plate 2*a* closes the cooling medium compartment 7 of said vessel 2 from the hot gas entering the vessel. The upstream end 10 is preferably positioned in the horizontal connecting duct between vessel 1 and vessel 2 as in FIG. 1.

FIG. 2 also shows a means 11 for extracting a volume 14 of the cooling medium from the cooling medium compartment 7. The illustrated means consist of a conduit 11 fluidly connected to a compartment 15. Cooling medium is extracted from compartment 15 by means of a pump 18 and the extracted volume is combined with fresh cooling medium as supplied via conduit 8. The combined mixture is supplied via conduit 13 to a compartment 20. Compartment 20 will cool the front of tube sheet 2*a*. Compartment 20 is in fluid communication with the inlet opening 21 of the annular sleeve 12. Annular sleeve 12 is positioned around the upstream end 10 of tube 4. Through the annular space between sleeve 12 and the exterior of upstream end 10 of tube 4 the mixture as fed from compartment 20 flows co-current with the flow of hot gas 22. Embodiments wherein the flow of the cooling mixture flows counter-current with the flow of hot gas are also possible. In order to have the best cooling at the position where the gas has the highest temperature, i.e. at the gas inlet 9, a co-current flow is preferred.

In FIG. 2 it is shown that the tip of the tube 4 extends somewhat towards the hot gas flow through tube plate 2*a*. This tip is also cooled by the cooling mixture from compartment 20 wherein the cooling mixture first flows counter-current the hot gas towards the tip of the tube in a space formed between tube sheet 2*a* and annular sleeve 12 and is redirected at the tip to subsequently flow co-current with the hot gas flow 22 from said tip to sleeve outlet opening 19. This design ensures a more efficient cooling of the tube wall when compared to the design as disclosed in for example earlier referred to U.S. Pat. No. 5,671,807 which does not have such a forced flow of cooling medium along the entire wall surface.

Compartment 15 is positioned between compartment 20 and cooling medium compartment 7 and is partly closed from cooling medium compartment 7 in order to avoid gas bubbles entering conduit 11 and/or pump 18. Steam bubbles, when the cooling medium is water, may form when for some reason fresh cooling medium supply fails or falls short or due to a low cooling medium flow in the annular sleeve 12. An opening 17 is provided to allow cooling medium to flow to compartment 15 from 7. Opening 17 and opening 19 are preferably sufficiently spaced away to avoid such bubbles entering compartment 15.

The cooling medium extracted from compartment 15 via conduit 11 may be cooled by means of indirect heat exchange. Such a heat exchanger may be positioned upstream or downstream pump 18. Such an additional cooling step is advantageous because a better cooling of the upstream tubular end of tube 4. Such additional cooling may also be advantageously applied in the embodiments as shown in FIGS. 3-6.

Figure 3:
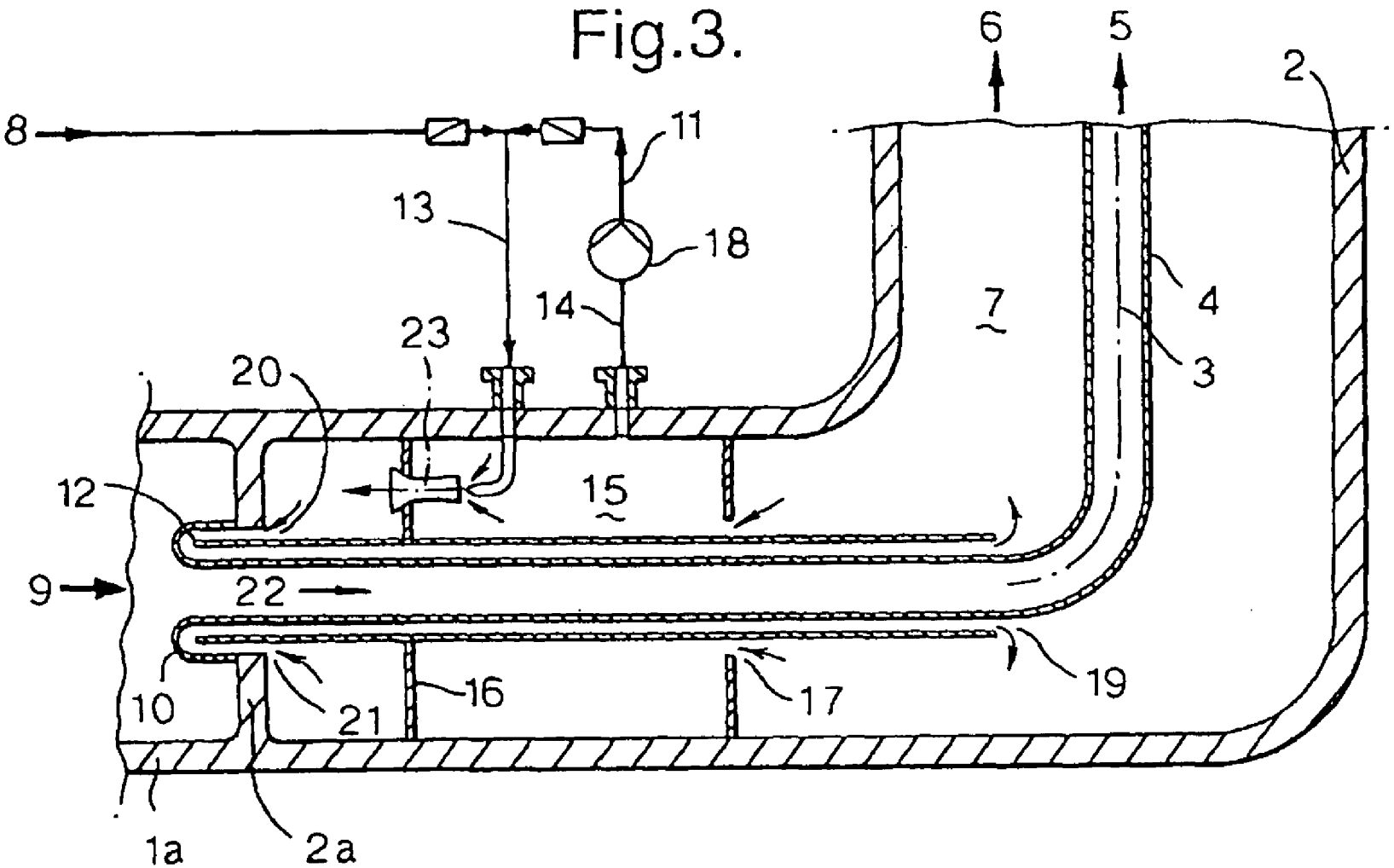
FIG. 3 is another embodiment of the vessel of FIG. 2.

FIG. 3 shows an embodiment comparable to that of FIG. 2 except that a preferred injector 23 is present. This injector 23 is positioned in the wall 16 dividing compartment 15 from compartment 20. The injector 23 entrains cooling medium-from compartment 15 to compartment 20 by means of the stream emitting from conduit 13. The cooling medium flow passing through the annular sleeve 12 may thus be considerably increased. This is advantageous because the cross-sectional area of the sleeve may then be larger and thus less sensitive in terms of construction tolerances.

Figure 4:
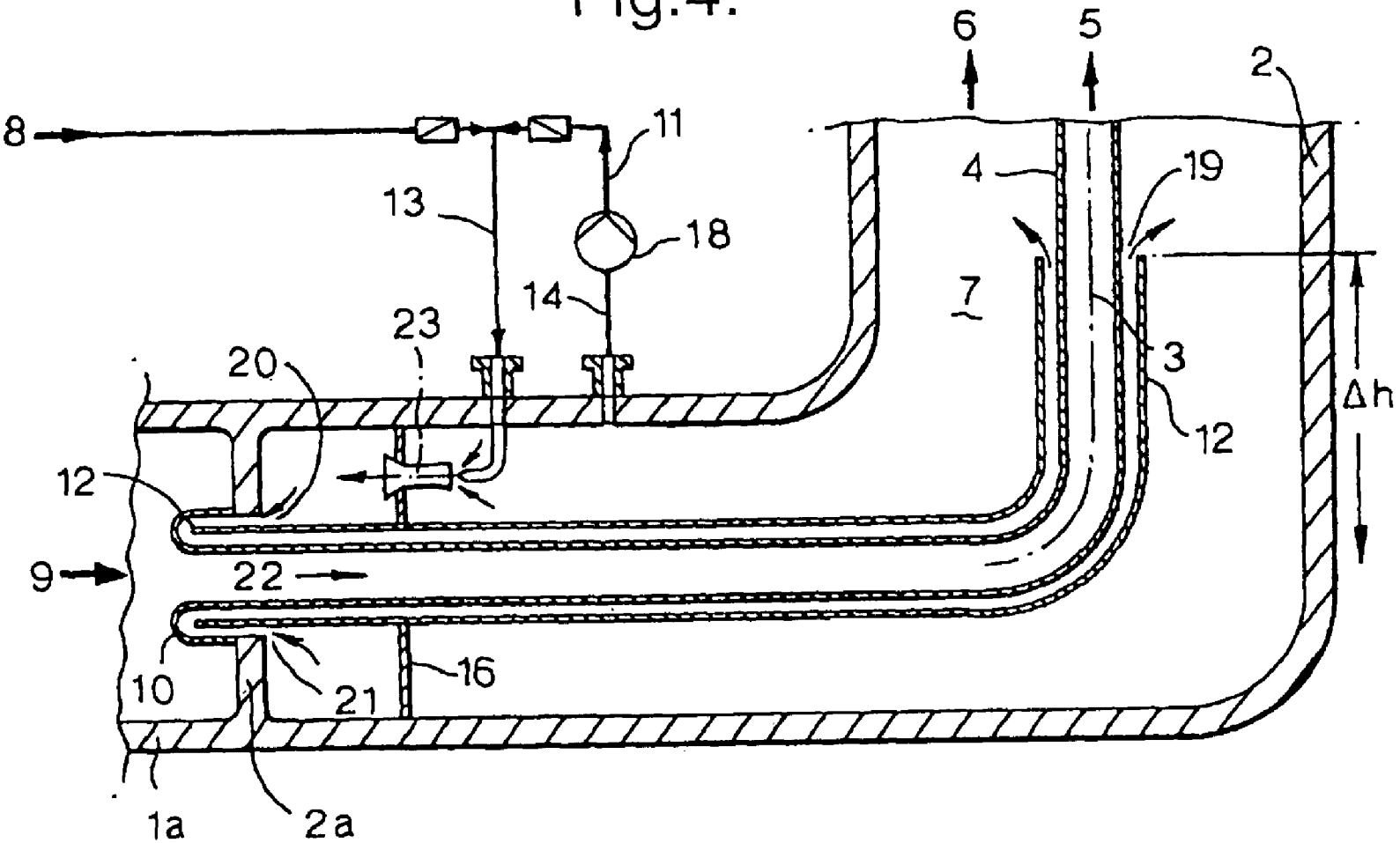
FIG. 4 is another embodiment of the vessel of FIG. 3.

FIG. 4 shows an embodiment as in FIG. 3 except in that the sleeve 12 is extended to the vertical part of the tube 4. Compartment 15 has been removed. In the event the flow via supply conduit 8 of fresh cooling medium stops steam could be generated in the sleeve 12. The vertically rising part of the sleeve 12 thus assists a natural convection which, combined with the opening in the injector 23, provides for adequate cooling of the upstream tubular part of vessel 2. In a preferred embodiment circulating pump 18 may be omitted because of this natural circulation.

Figure 5:
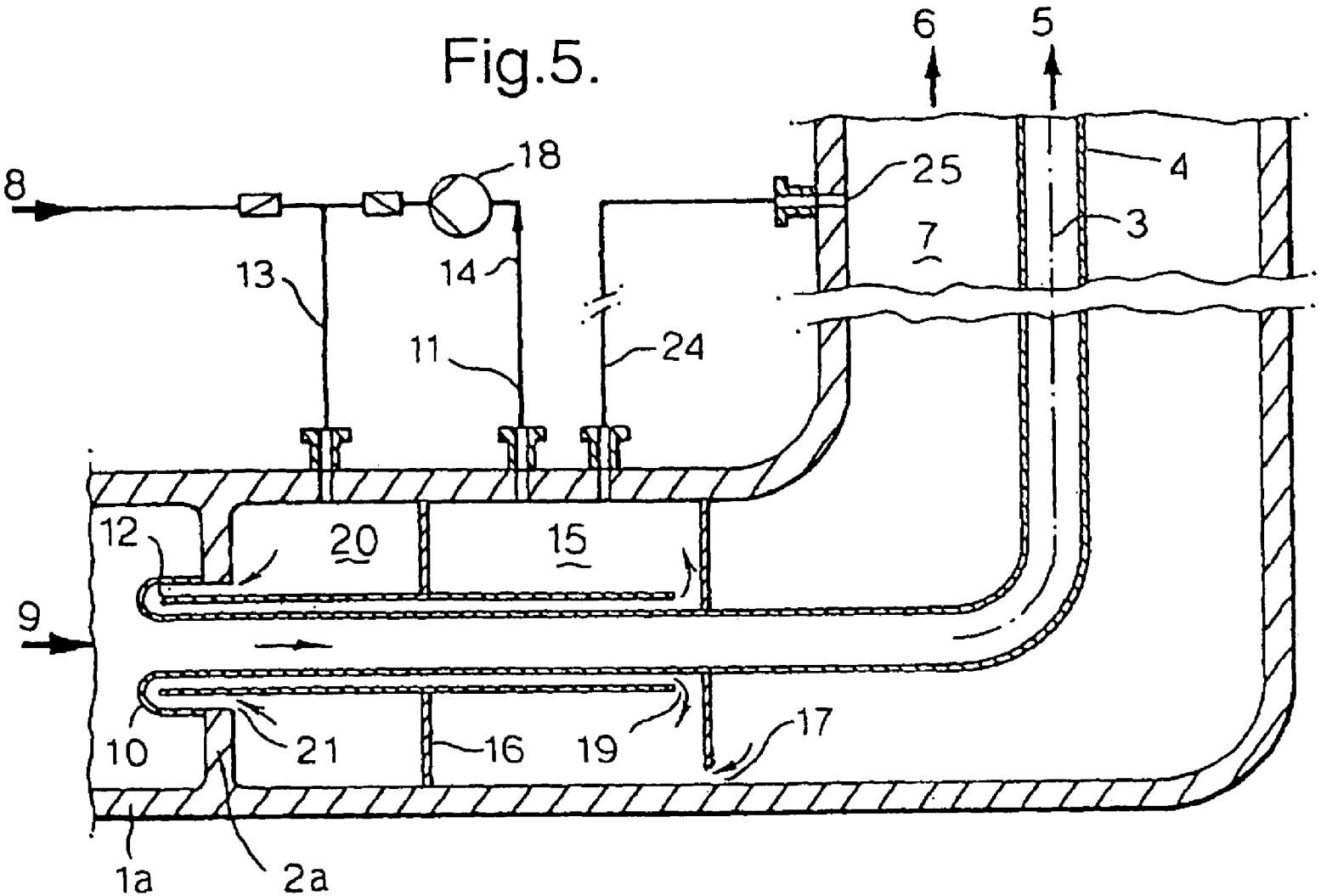
FIG. 5 is another embodiment of the vessel of FIG. 2.

FIG. 5 shows an embodiment as in FIG. 2 except that additionally a conduit 24 is present which allows relatively cold cooling medium to be fed to a higher position 25 in vessel 1. In vessel 2 a natural circulation of cooling medium is established in the vertical cooler part, which is not shown in the above-mentioned figures. A water-steam mixture rises local to the tube 4 helix (see FIG. 1). The steam bubbles further rise into the steam space and the liquid water with its higher density flows downwards through so-called downcomers. The addition of relatively cold cooling medium at a position where the cooling medium starts to move downwards in the downcomer is advantageous because it improves this natural circulation effect in vessel 2. Because the outlet 19 of sleeve 12 is positioned in compartment 15 any gas bubbles, which could form when fresh cooling medium is not supplied to the vessel 2, can be discharged towards the top of the vessel 2 via conduit 24. A pertinent balancing opening 17 allows for boiling water to be re-fed into the inlet zone in order to replace the steam flow discharge.

Figure 6:
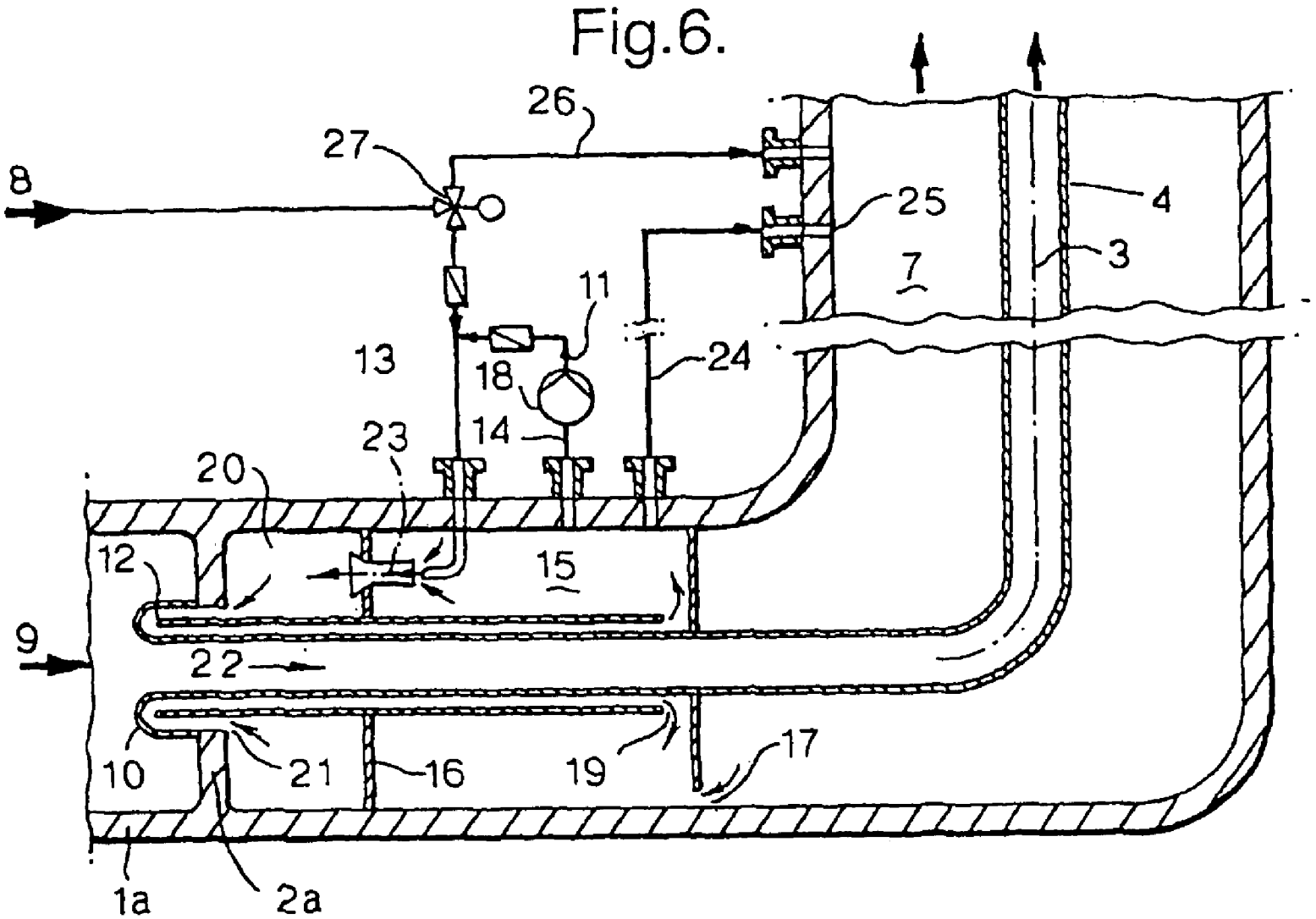
FIG. 6 is another embodiment of the vessel of FIG. 3.

FIG. 6 shows an embodiment as in FIG. 3 except that additionally a conduit 24 is present which allows relatively cold cooling medium to be fed to a higher position 25 in vessel 1. This additional conduit 24 has the same functionality as described for when discussing FIG. 5. Additionally a three-way valve 27 and a conduit 26 is present. The three-way valve allows the operator to by-pass some of the fresh cooling medium directly to the upper part of the vessel via conduit 26. This is advantageous because it allows for minimisation of temperature variation in the inlet zone in the case of hot gas load changes.

The invention is also directed to a process to cool hot gas. The hot gas is preferably the effluent of a gasification process, also referred to as partial oxidation. The gasification feed is preferably a hydrocarbon-containing fuel, which may be a gaseous fuel or a liquid fuel. Examples of possible feedstocks include natural gas and refinery streams such as middle distillates and more preferably fractions boiling above 370° C., such as those obtained in a vacuum distillation column. Examples are the vacuum distillates and the residue as obtained by a vacuum distillation of the 370° C. plus fraction as obtained when distilling a crude petroleum feedstock. The hot gas as obtained in a gasification process will comprise mainly of carbon monoxide and hydrogen.

The temperature of the hot gas is preferably between 1300 and 1500° C. The temperature of the cooled gas after being treated by the process according the invention is between 240 and 450° C. The pressure of the hot gas is suitably between 20 and 80 bar.

The apparatus may have a general design as disclosed in the afore mentioned publications EP-A-774103 and U.S. Pat. No. 5,671,807. The difference for the apparatus will be how the upstream end of the tubular part is cooled. The cooling medium is preferably water.

The cooling of the main tubular part, defined as activity (i), is performed by an evaporating liquid cooling medium flowing freely around said tube. The evaporated cooling medium, e.g. steam, is collected in the upper end of the cooling apparatus and discharged. Steam as obtained in such a process may be advantageously be used for energy recovery and the like.

In activity(ii) the upstream tubular part is cooled by passing fresh liquid cooling medium and a defined part of the liquid cooling medium of activity (i) along the exterior of the upstream end of the tube. The volume ratio of fresh cooling medium and the defined part of the cooling medium as extracted from activity (i) is suitable between 1:4 and 4:1.

The mixture of cooling media as such obtained may pass in any manner along the exterior of the upstream tubular part. Preferably, the mixture of cooling media is passed counter-currently with respect to the gas flowing within the tube along the exterior surface. More preferably co-current the cooling mixture is passed with the gas flowing within the tube. By passing said mixture in a co-current manner a lower maximum wall temperature is achieved than when passing said liquid in a counter-current manner. This lower wall temperature is more preferred than the higher heat exchange efficiency as would be achieved in a counter-current operation if one views the mechanical integrity of the process and its hardware.

After being used in cooling the upstream tubular part the mixture of cooling media is further used in activity (i). Thus in this manner part of the cooling medium of activity (i) is continuously used in activity (ii) and recycled to activity (i).

We claim:

1. A process to cool hot gas from a partial oxidation reactor that is fluidly connected at its lower end to a horizontal duct, which horizontal duct is fluidly connected to a tube having a main tubular part which is positioned in a vessel and is arranged vertically therein, and an upstream tubular part which is positioned in said horizontal duct and is arranged horizontally therein, said upstream tubular part being sealingly connected to a tube sheet that is also positioned in said horizontal duct and which is arranged vertically therein, said process comprising passing the hot gas through said tube, (i) cooling the exterior of said main tubular part by an evaporating liquid cooling medium flowing freely inside said vessel and around said tube, (ii) cooling the upstream tubular part and said tube sheet by passing a mixture of fresh liquid cooling medium and a defined part of the liquid cooling medium of activity (i) along the exterior of the upstream tubular part and a side of said tube sheet, and (iii) using as cooling medium in activity (i) the mixture of fresh liquid cooling medium and the defined part of the liquid cooling medium after being used to cool the upstream tubular part and tube sheet.

2. The process according to claim 1, wherein the volume ratio of fresh liquid cooling medium and the defined part of the liquid cooling medium as extracted from activity (i) is between 1:4 and 4:1.

3. The process according to claim 2, wherein the upstream tubular part is cooled by passing fresh liquid cooling medium and a defined part of the liquid cooling medium of activity (i) along the exterior of the upstream end of the tube co-current with the gas flowing within the tube.

4. The process of claim 2, wherein the mixture of fresh liquid cooling medium and the defined part of the liquid cooling medium is injected into a compartment surrounding said upstream tubular part.

5. The process of claim 4, wherein in the event the flow of fresh liquid cooling medium is interrupted, the flow of the defined part of the cooling medium is continued to cool the inlet section of said upstream tubular part in said horizontal duct.

6. The process according to claim 3, wherein the hot gas has a temperature of between 1300 and 1500° C. and a temperature of between 240 and 450° C. after being subjected to the process.

7. The process according to claim 6, wherein the hot gas is obtained in a gasification process, comprising the partial oxidation of a gaseous or liquid hydrocarbon feedstock to a mixture comprising mainly hydrogen and carbon monoxide.

8. The process of claim 1, wherein relatively cold cooling medium is supplied to an elevated position in said vessel to establish a natural circulation of the cooling medium.

9. The process of claim 8, wherein both fresh liquid cooling medium and extracted liquid cooling medium are fed to an elevated position in said vessel.

10. An apparatus for cooling hot gas from a partial oxidation reactor comprising:

(i) a vessel fluidly connected to said partial oxidation reactor by means of a horizontal duct, said vessel and horizontal duct being provided with a cooling medium compartment, an inlet to supply fresh cooling medium and a outlet for discharge of used cooling medium, said vessel and horizontal duct further provided with an inlet for hot gas and an outlet for cooled gas, at least one heat exchange tube fluidly connecting the inlet for hot gas and the outlet for cooled gas positioned in the cooling medium compartment, wherein the downstream end of said heat exchange tube is positioned in said vessel and arranged vertically therein, and wherein the upstream end of said heat exchange tube is positioned in said horizontal duct and is arranged horizontally therein, said upstream tubular part being sealingly attached to a tube sheet that is also positioned in said horizontal duct and is arranged vertically therein, (ii) a means for extracting a volume of the cooling medium from the cooling medium compartment, and wherein (iii) the upstream end of said heat exchange tube in said horizontal duct is provided with a cooling means comprising means to supply a mixture of the extracted liquid cooling medium and part or all of the fresh liquid cooling medium along the exterior of the upstream end of said heat exchange tube and a side of said tube sheet in said horizontal duct.

11. The apparatus according to claim 10, wherein an annular sleeve is positioned around the upstream end of the heat exchange tube and wherein the annular sleeve has an opening to allow the mixture of extracted cooling medium and part or all of the fresh cooling medium to enter the space between the upstream end of the heat exchange tube and the annular sleeve and an outlet opening fluidly connected to the cooling medium compartment.

12. The apparatus according to claim 11, wherein means to supply part of the fresh cooling medium to an elevated position in the vessel is present.

13. The apparatus according to claim 10, wherein said cooling medium compartment is divided into a plurality of cooling medium compartments, including a first compartment from which a volume of cooling medium is extracted, and a second compartment into which the mixture of extracted cooling medium and fresh cooling medium is supplied, said second compartment being positioned in said horizontal duct.

14. The apparatus of claim 13, wherein an injector is present and is positioned in a wall dividing said first cooling medium compartment and said second cooling medium compartment.

* * * * *